US011181303B2

(12) United States Patent
Asanuma et al.

(10) Patent No.: US 11,181,303 B2
(45) Date of Patent: Nov. 23, 2021

(54) AIR-CONDITIONING APPARATUS AND AIR-CONDITIONING SYSTEM

(71) Applicant: Mitsubishi Electric Corporation, Tokyo (JP)

(72) Inventors: Hiroaki Asanuma, Tokyo (JP); Katsuhiro Ishimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 27 days.

(21) Appl. No.: 16/330,889

(22) PCT Filed: Nov. 22, 2016

(86) PCT No.: PCT/JP2016/084569
§ 371 (c)(1),
(2) Date: Mar. 6, 2019

(87) PCT Pub. No.: WO2018/096576
PCT Pub. Date: May 31, 2018

(65) Prior Publication Data

US 2020/0049384 A1 Feb. 13, 2020

(51) Int. Cl.
*F25B 13/00* (2006.01)
*F25B 49/02* (2006.01)
(Continued)

(52) U.S. Cl.
CPC ..... *F25B 13/00* (2013.01); *F25B 49/02* (2013.01); *F24F 1/00073* (2019.02);
(Continued)

(58) Field of Classification Search
CPC .. F25B 13/00; F25B 49/02; F25B 2313/0233; F25B 2500/221; F25B 2500/222; F25B 49/005; F24F 2110/10; F24F 1/00073
See application file for complete search history.

(56) References Cited

U.S. PATENT DOCUMENTS 5,586,445 A * 12/1996 Bessler ..... F25B 49/005 62/126
2008/0209926 A1* 9/2008 Matsuoka ..... F25B 13/00 62/129
(Continued)

FOREIGN PATENT DOCUMENTS

CN 1965203 A 5/2007
CN 202188563 U * 4/2012
(Continued)

OTHER PUBLICATIONS

Sotozono et al., Refrigeration and Air Conditioning Device & System., Jun. 20, 2013, JP2013122364A, Whole Document (Year: 2013).*
(Continued)

*Primary Examiner* — Larry L Furdge
(74) *Attorney, Agent, or Firm* — Posz Law Group, PLC

(57) ABSTRACT

An air-conditioning apparatus includes a refrigerant circuit in which a compressor, a heat source heat exchanger, an expansion device, and a load heat exchanger are connected via refrigerant pipes; a refrigerant leakage sensor configured to output a refrigerant leakage detection signal indicating detection of refrigerant leakage when the refrigerant leakage sensor detects the refrigerant leakage; a refrigerant leakage cutoff device configured to cut off a flow of refrigerant when the refrigerant leakage cutoff device is set to a closed state; and a controller configured to determine whether refrigerant leakage occurs on the basis of an operating state and whether the refrigerant leakage detection signal is received from the refrigerant leakage sensor. When the controller receives the refrigerant leakage detection signal and determines, on the basis of the operating state, that the refrigerant leakage occurs, the controller is configured to set the refrigerant leakage cutoff device to the closed state.

19 Claims, 6 Drawing Sheets

(51) Int. Cl.
*F24F 110/10* (2018.01)
*F24F 1/0007* (2019.01)

(52) U.S. Cl.
CPC ... *F24F 2110/10* (2018.01); *F25B 2313/0233* (2013.01); *F25B 2500/221* (2013.01); *F25B 2500/222* (2013.01)

(56) References Cited

U.S. PATENT DOCUMENTS

| | | | | |
|---|---|---|---|---|
| 2013/0098576 | A1 | 4/2013 | Fujitaka et al. | |
| 2017/0198946 | A1* | 7/2017 | Takenaka | F25B 41/20 |
| 2018/0045424 | A1* | 2/2018 | Yajima | F24F 11/30 |

FOREIGN PATENT DOCUMENTS

| | | | | |
|---|---|---|---|---|
| CN | 104566677 | A | | 4/2015 |
| EP | 2669607 | A1 | | 12/2013 |
| JP | H03247932 | A | * | 11/1991 |
| JP | H04-055671 | A | | 2/1992 |
| JP | H04369370 | A | * | 12/1992 |
| JP | H06137725 | A | * | 5/1994 |
| JP | H0868569 | A | * | 3/1996 |
| JP | 2000-097527 | A | | 4/2000 |
| JP | 2002340462 | A | * | 11/2002 |
| JP | 2003232585 | A | * | 8/2003 |
| JP | 2010210129 | A | * | 9/2010 |
| JP | 2012-013348 | A | | 1/2012 |
| JP | 2012211723 | A | * | 11/2012 |
| JP | 2013122364 | A | * | 6/2013 |
| JP | 2013-151352 | A | | 8/2013 |
| WO | 2015/056704 | A1 | | 4/2015 |

OTHER PUBLICATIONS

Washimi, Refrigerant Leakage Detection Method for Refrigeration Device, May 20, 1994, JPH06137725A, Whole Document (Year: 1994).*
Sakurai et al., Freezer and Method for Detecting Refrigerant Leakage in the Freezer, Nov. 1, 2012, JP2012211723A, Whole Document (Year: 2012).*
Asakura, Electric Refrigerator, Nov. 27, 2002, JP2002340462A, Whole Document (Year: 2002).*
Matsushima et al., Air Conditioner, Dec. 22, 1992, JPH04369370A, Whole Document (Year: 1992).*
Zhou et al., Air Conditioner Using a Flammable Secondary Refrigerant, Apr. 11, 2012, CN202188563U, Whole Document (Year: 2012).*
Myojin et al., Refrigerator, Aug. 22, 2003, JP2003232585A, Whole Document (Year: 2003).*
Hara, Air Conditioner, Nov. 6, 1991, JPH03247932A, Whole Document (Year: 1991).*
Watabe et al., Cooling System, Sep. 24, 2010, JP2010210129A, Whole Document (Year: 2010).*
Noguchi et al., Ammonia Absorption Type Heat Pump System, Mar. 12, 1996, JPH0868569A, Whole Document (Year: 1996).*
Extended European Search Report dated Aug. 6, 2019 issued in corresponding EP patent application No. 16922563.8.
Office Action dated Jun. 16, 2020 issued in corresponding CN patent application No. 201680090632.9 ( and English translation).
Office Action dated Jan. 19, 2021 issued in corresponding CN patent application No. 201680090632.9 (and English translation).
Decision of Rejection dated Apr. 30, 2021, issued in corresponding CN Patent Application No. 201680090632.9 (and English Machine Translation).

* cited by examiner

AIR-CONDITIONING APPARATUS AND AIR-CONDITIONING SYSTEM

CROSS REFERENCE TO RELATED APPLICATION

This application is a U.S. national stage application of International Application No. PCT/JP2016/084569, filed on Nov. 22, 2016, the contents of which are incorporated herein by reference.

TECHNICAL FIELD

The present invention relates to an air-conditioning apparatus equipped with a refrigerant circuit as well as to an air-conditioning system equipped with a plurality of the air-conditioning apparatuses.

BACKGROUND

With a conventional air-conditioning apparatus such as a multi-air-conditioning apparatus for building, the total extension of refrigerant pipes connecting an outdoor unit with a plurality of indoor units can reach a few hundred meters. In this case, the amount of refrigerant used increases in proportion to the length of the refrigerant pipes. With such an air-conditioning apparatus, in case of refrigerant leakage, a large amount of refrigerant may leak in a single room.

In recent years, from the perspective of preventing global warming, there has been demand for changeover to a refrigerant with a lower global warming potential, but refrigerants with a low global warming potential often have flammability. When changeover to a refrigerant with a low global warming potential progresses in future, more attention to safety will become necessary. As safety measures to deal with a situation in which refrigerant leaks into a room, a technique is proposed that reduces the amount of leaked refrigerant in case of refrigerant leakage by installing a cutoff valve to cut off the flow of refrigerant in a refrigerant circuit (see, for example, Patent Literature 1).

Also, as a technique for safety measures against refrigerant leakage, another example is disclosed in Patent Literature 2. Patent Literature 2 discloses an air-conditioning apparatus including a temperature distribution detection unit configured to detect temperature distribution in a room; a refrigerant leakage detection unit configured to detect refrigerant leakage; an air-sending control unit configured to control an air-sending unit; and an airflow direction control unit configured to control a direction of airflow from the air-sending unit. With this air-conditioning apparatus, when the refrigerant leakage detection unit detects refrigerant leakage, the temperature distribution detection unit detects any resident and heat source device, and the air-sending control unit and airflow direction control unit diffuse refrigerant in a direction that deviates from the resident and heat source device.

PATENT LITERATURE

Patent Literature 1: Japanese Unexamined Patent Application Publication No. 2000-97527

Patent Literature 2: Japanese Unexamined Patent Application Publication No. 2012-13348

With the air-conditioning apparatus disclosed in Patent Literature 1, when refrigerant leakage is detected, the cutoff valve operates to cut off the flow of refrigerant in the refrigerant circuit, stopping operation of the air-conditioning apparatus, but the operation stops in case of false detection of refrigerant leakage as well. This action results in degradation of user comfort.

Also, with the air-conditioning apparatus disclosed in Patent Literature 2, because the air-sending control unit and airflow direction control unit operate to diffuse refrigerant in a direction that deviates from the resident even when the refrigerant leakage detection unit falsely detects refrigerant leakage, operation of the air-conditioning apparatus is not maintained.

SUMMARY

The present invention has been made to solve the above problem and has an object to provide an air-conditioning apparatus and air-conditioning system that combine comfort and safety against refrigerant leakage.

An air-conditioning apparatus according to one embodiment of the present invention includes a refrigerant circuit in which a compressor, a heat source heat exchanger, an expansion device, and a load heat exchanger are connected via refrigerant pipes; a refrigerant leakage sensor configured to output a refrigerant leakage detection signal indicating detection of refrigerant leakage when the refrigerant leakage sensor detects the refrigerant leakage; a refrigerant leakage cutoff device configured to cut off a flow of refrigerant when the refrigerant leakage cutoff device is set to a closed state; and a controller configured to determine whether refrigerant leakage occurs on the basis of an operating state and whether the refrigerant leakage detection signal is received from the refrigerant leakage sensor. When the controller receives the refrigerant leakage detection signal and determines, on the basis of the operating state, that the refrigerant leakage occurs, the controller is configured to set the refrigerant leakage cutoff device to the closed state.

An air-conditioning system according to another embodiment of the present invention includes a plurality of the air-conditioning apparatuses according to the one embodiment of the present invention; and a duct including a plurality of branch ducts each connected to a corresponding one of a plurality of the load heat exchangers, and a junction joining together the plurality of branch ducts and connecting the plurality of branch ducts to an identical space. The plurality of the air-conditioning apparatuses are each configured to air-condition the identical space and share the refrigerant leakage sensor installed in the identical space, a plurality of the refrigerant leakage cutoff devices are each provided in a corresponding one of the plurality of branch ducts, and when one of a plurality of the controllers determines that the refrigerant leakage occurs, the one of the plurality of the controllers is configured to set a corresponding one of the plurality of the refrigerant leakage cutoff devices provided in a corresponding one of the plurality of branch ducts connected to the load heat exchanger of a corresponding one of the plurality of the air-conditioning apparatuses to the closed state.

According to an embodiment of the present invention, a determination as to whether refrigerant leakage occurs is made on the basis of the logical product of two conditions: detection by the refrigerant leakage sensor and operating state. When it is determined that refrigerant leakage occurs on the basis of the two conditions, the flow of refrigerant is cut off, and when it is determined that no refrigerant leakage occurs on the basis of either one of the two conditions, air-conditioning operation is maintained, which makes it possible to combine comfort and safety.

DETAILED DESCRIPTION

Embodiments of an air-conditioning apparatus and air-conditioning system will be described below with reference to the drawings. Note that in the accompanying drawings, components may not be shown in their true size relations. Also, in the accompanying drawings, the components denoted by the same reference signs are the same or equivalent components and are common throughout the entire specifications. Furthermore, the forms of the components described throughout the specifications are strictly exemplary, and the components are not limited to the forms described in the specifications.

Embodiment 1

Figure 1:
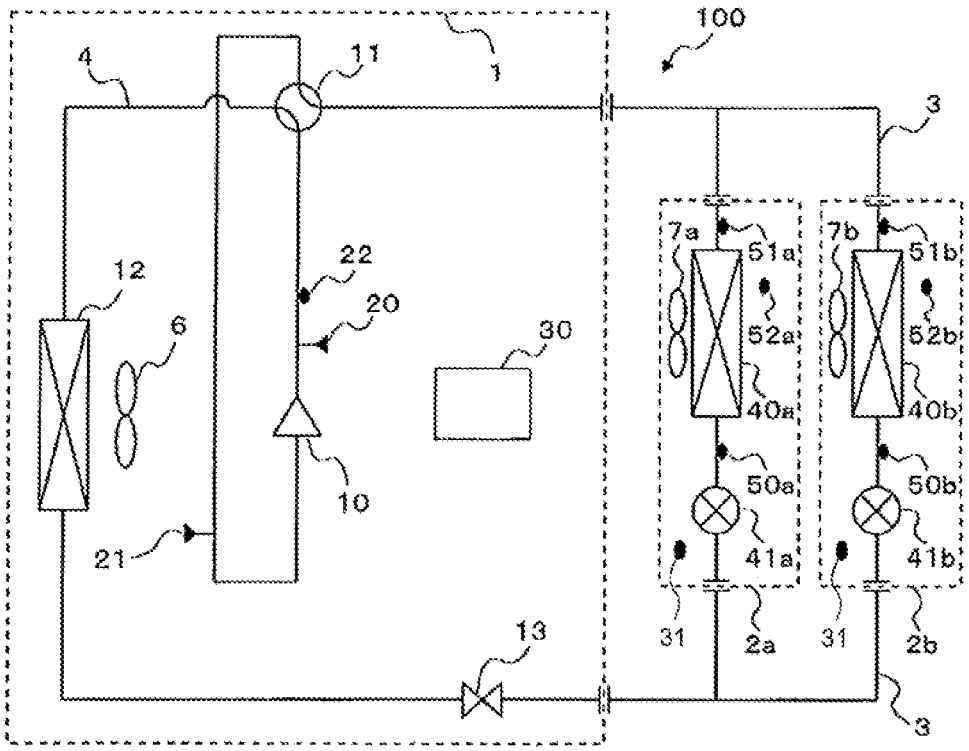
FIG. 1 is a refrigerant circuit diagram showing an example of a circuit configuration of an air-conditioning apparatus according to Embodiment 1 of the present invention.

FIG. 1 is a refrigerant circuit diagram showing an example of a circuit configuration of an air-conditioning apparatus according to Embodiment 1 of the present invention. Detailed configuration of the air-conditioning apparatus 100 will be described with reference to FIG. 1. The air-conditioning apparatus 100 circulates refrigerant in the circuit and thereby conditions air using a refrigeration cycle. The air-conditioning apparatus 100 allows selection of a cooling only operation mode in which all operating indoor units perform cooling operation or heating only operation mode in which all operating indoor units perform heating operation, for example, as with multi-air-conditioning apparatuses for building and other similar air-conditioning apparatuses. As shown in FIG. 1, an outdoor unit 1 and indoor units 2*a* and 2*b* are interconnected by main refrigerant pipes 3. Two indoor units 2*a* and 2*b* are connected to the outdoor unit 1 in the example shown in FIG. 1. The number of indoor units connected to the outdoor unit 1 is not limited to two. The refrigerant is a flammable refrigerant such as R32 or a refrigerant mixture containing R32.

In Embodiment 1, description will be given of a case in which the air-conditioning apparatus 100 is a model in which a relatively large amount of refrigerant is enclosed in the refrigerant circuit, with a plurality of indoor units being connected to the outdoor unit as with multi-air-conditioning apparatuses for building and other similar air-conditioning apparatuses. A technique described in Embodiment 1 is applicable not only to a case in which a plurality of indoor units are connected to one outdoor unit, but also to models in which an outdoor unit and indoor unit are connected in a one-to-one relationship as with a room air-conditioning apparatus or packaged air-conditioning apparatus.

As shown in FIG. 1, the outdoor unit 1 includes a compressor 10, a refrigerant flow switching device 11 such as a four-way valve, a heat source heat exchanger 12, and a refrigerant circuit cutoff device 13. The compressor 10, refrigerant flow switching device 11, heat source heat exchanger 12, and refrigerant circuit cutoff device 13 are connected via refrigerant pipes 4. Also, an air-sending device 6 is provided in the vicinity of the heat source heat exchanger 12. The air-sending device 6 sends air to the heat source heat exchanger 12.

Note that, in Embodiment 1, although description will be given of a case in which a heat source of the heat source heat exchanger 12 is air, water or brine may be used as a heat source and a pump may be installed instead of the air-sending device 6 to circulate water or brine.

The compressor 10 suctions low-temperature, low-pressure refrigerant and compresses and discharges the refrigerant in a high-temperature, high-pressure state. The compressor 10 may be, for example, an inverter compressor capable of controlling capacity. The refrigerant flow switching device 11 switches between a flow of refrigerant in cooling operation mode and a flow of refrigerant in heating operation mode.

The heat source heat exchanger 12 acts as a condenser during cooling operation, and as an evaporator during heating operation. The heat source heat exchanger 12 exchanges heat between the air supplied, for example, from an air-sending device 6 and the refrigerant. The refrigerant circuit cutoff device 13 cuts off the flow of refrigerant circulating through the refrigerant pipes 4. The refrigerant circuit cutoff device 13 is made up, for example, of a solenoid valve or other similar device. The refrigerant circuit cutoff device 13 is not limited to a solenoid valve, and may be any component that can cut off the flow of refrigerant. According to Embodiment 1, the refrigerant circuit cutoff device 13 acts as a refrigerant leakage cutoff device configured to cut off the flow of refrigerant in the refrigerant pipes 4 and thereby keep the refrigerant from leaking into an air-conditioned space from the refrigerant circuit.

The outdoor unit 1 is provided with pressure sensors: a first pressure sensor 20 and a second pressure sensor 21. The first pressure sensor 20 is provided on the refrigerant pipe 4 connecting a discharge portion of the compressor 10 with the refrigerant flow switching device 11. The first pressure sensor 20 detects pressure P1 of high-temperature, high-pressure refrigerant compressed by and discharged from the compressor 10. The second pressure sensor 21 is provided on the refrigerant pipe 4 connecting the refrigerant flow switching device 11 with a suction portion of the compressor 10. The second pressure sensor 21 detects pressure of low-temperature, low-pressure refrigerant suctioned into the compressor 10.

Also, the outdoor unit 1 is provided with a first temperature sensor 22 as a temperature sensor. The first temperature sensor 22 is provided on the refrigerant pipe 4 connecting the discharge portion of the compressor 10 with the refrigerant flow switching device 11. The first temperature sensor 22 detects temperature T1 of the high-temperature, high-pressure refrigerant compressed by and discharged from the compressor 10. The first temperature sensor 22 is made up, for example, of a thermistor or other similar device.

The indoor unit 2*a* includes an air-sending device 7*a*, a load heat exchanger 40*a*, and an expansion device 41*a*. The indoor unit 2*b* includes an air-sending device 7*b*, a load heat exchanger 40*b*, and an expansion device 41*b*. The indoor units 2*a* and 2*b* are connected to the outdoor unit 1 via the main refrigerant pipes 3, and refrigerant flows in and out of the indoor units 2*a* and 2*b* from and to the outdoor unit 1. The load heat exchangers 40*a* and 40*b* exchange heat between air supplied, for example, from air-sending devices 7*a* and 7*b* and the refrigerant and thereby generate heating air or cooling air to be supplied to indoor space. Also, the expansion devices 41*a* and 41*b* have functions as pressure reducing valves and expansion valves. The expansion devices 41*a* and 41*b* decompress and thereby expand the refrigerant. The expansion devices 41*a* and 41*b*, whose opening degrees can be controlled variably, are made up, for example, of electronic expansion valves or other similar devices.

In Embodiment 1, description will be given of a case in which multi-air-conditioning apparatuses for building typically using distribution control in which indoor units are controlled individually, the expansion devices 41*a* and 41*b* are installed in the indoor units 2*a* and 2*b*, but an expansion device may be installed in the outdoor unit 1.

The indoor unit 2*a* has a second temperature sensor 50*a* provided on a pipe connecting the expansion device 41*a* with the load heat exchanger 40*a*. The indoor unit 2*b* has a second temperature sensor 50*b* provided on a pipe connecting the expansion device 41*b* with the load heat exchanger 40*b*. Also, a third temperature sensor 51*a* is provided on a pipe across the load heat exchanger 40*a* from the expansion device 41*a*. A third temperature sensor 51*b* is provided on a pipe across the load heat exchanger 40*b* from the expansion device 41*b*. Furthermore, a fourth temperature sensor 52*a* is provided in an air inlet port of the load heat exchanger 40*a*. A fourth temperature sensor 52*b* is provided in an air inlet port of the load heat exchanger 40*b*.

The second temperature sensors 50*a* and 50*b* detect the temperature of the refrigerant flowing into the load heat exchangers 40*a* and 40*b* during cooling operation. Also, the third temperature sensors 51*a* and 51*b* detect the temperature of the refrigerant flowing out of the load heat exchangers 40*a* and 40*b*. Furthermore, the fourth temperature sensors 52*a* and 52*b* detect the temperature of air in the room. These temperature sensors are made up, for example, of thermistors or other similar devices.

Figure 2:
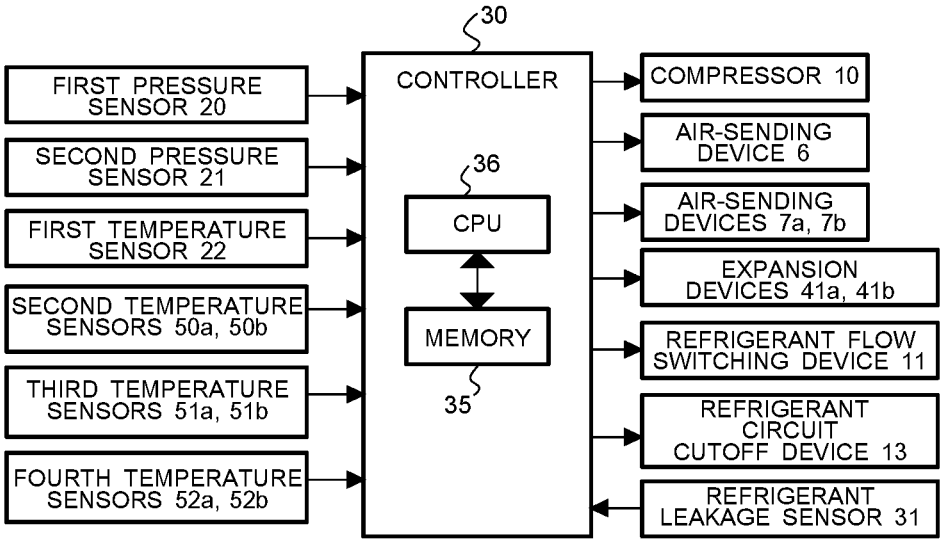
FIG. 2 is a block diagram showing a configuration example related to control over the air-conditioning apparatus according to Embodiment 1 of the present invention.

Also, as shown in FIG. 1, the air-conditioning apparatus 100 includes a controller 30 and refrigerant leakage sensors 31. FIG. 2 is a block diagram showing a configuration example related to control over the air-conditioning apparatus according to Embodiment 1 of the present invention. As shown in FIG. 2, the controller 30 includes a memory 35 configured to store programs and a CPU (Central Processing Unit) 36 configured to performing processing in accordance with the programs. The controller 30 is, for example, a microcomputer.

The controller 30 is connected with the compressor 10, refrigerant flow switching device 11, refrigerant circuit cutoff device 13, air-sending device 6, first pressure sensor 20, second pressure sensor 21, and first temperature sensor 22 via transmission lines. The controller 30 is connected with the air-sending devices 7*a* and 7*b*, load heat exchangers 40*a* and 40*b*, and expansion devices 41*a* and 41*b* via transmission lines. The controller 30 is connected with the second temperature sensors 50*a* and 50*b*, third temperature sensors 51*a* and 51*b*, and fourth temperature sensors 52*a* and 52*b* via transmission lines. The controller 30 is connected with a non-illustrated remote control via a transmission line. The controller 30 is connected with the refrigerant leakage sensor 31 via a wired or wireless communication link.

The refrigerant leakage sensor 31 detects refrigerant leakage directly or indirectly. Examples of methods for indirectly detecting refrigerant leakage include a method that detects oxygen concentration in the air and determines that refrigerant concentration has increased when the oxygen concentration in the air decreases. When the refrigerant leakage sensor 31 detects refrigerant leakage, the refrigerant leakage sensor 31 transmits a refrigerant leakage detection signal indicating detection of refrigerant leakage, to the controller 30.

The controller 30 has a function to receive the refrigerant leakage detection signal and a function to reduce refrigerant leakage. These two functions allow the controller 30 to determine whether refrigerant leakage occurs on the basis of the logical product of the two conditions and perform refrigerant leakage control when the controller 30 determines that refrigerant leakage occurs. These two functions will be described in detail.

The function to receive the refrigerant leakage detection signal is a function to receive the refrigerant leakage detection signal sent from the refrigerant leakage sensor 31. This function allows the controller 30 to determine whether one of the two conditions for determination of refrigerant leakage is satisfied. The function to reduce refrigerant leakage includes a function to determine whether refrigerant leakage occurs on the basis of the logical product of the two conditions and a function to perform refrigerant leakage control when a result of the logical product is true. Using the function to determine whether refrigerant leakage occurs, the controller 30 determines whether refrigerant leakage occurs on the basis of the result of the logical product of the two conditions: reception of a refrigerant leakage detection signal and an operating state. The function to perform refrigerant leakage control is a function of the controller 30 to cause the compressor 10, refrigerant flow switching device 11, expansion devices 41*a* and 41*b*, refrigerant circuit cutoff device 13, and other devices to reduce refrigerant leakage. Operation of the controller 30 related to these functions will be described in detail later.

Also, the controller 30 performs refrigeration cycle control as follows. On the basis of detection values of the detection devices and commands from a remote control, the controller 30 conducts operation modes described later by controlling frequency of the compressor 10, activation and deactivation states and rotation frequencies of the air-sending devices 6, 7*a*, and 7*b*, switching of flow paths on the refrigerant flow switching device 11, opening degrees of the expansion devices 41*a* and 41*b*, and other parameters. Note that although in the configuration example shown in FIG. 1, the controller 30 is provided in the outdoor unit 1 and the refrigerant leakage sensors 31 are provided in the indoor units 2*a* and 2*b*, installation locations of the controller 30 and refrigerant leakage sensors 31 are not limited to these installation locations shown in FIG. 1. For example, when the indoor units 2*a* and 2*b* are installed in a common air-conditioned space, the refrigerant leakage sensor 31 may be provided in either one of the indoor units 2*a* and 2*b*. Also, the controller 30 may be provided in each of the indoor units 2*a* and 2*b*, and the controllers each provided in a corresponding one of the indoor units 2*a* and 2*b* may be interconnected via a transmission line. Furthermore, the controller 30 may be provided in either of the indoor units 2*a* and 2*b*.

Figure 3:
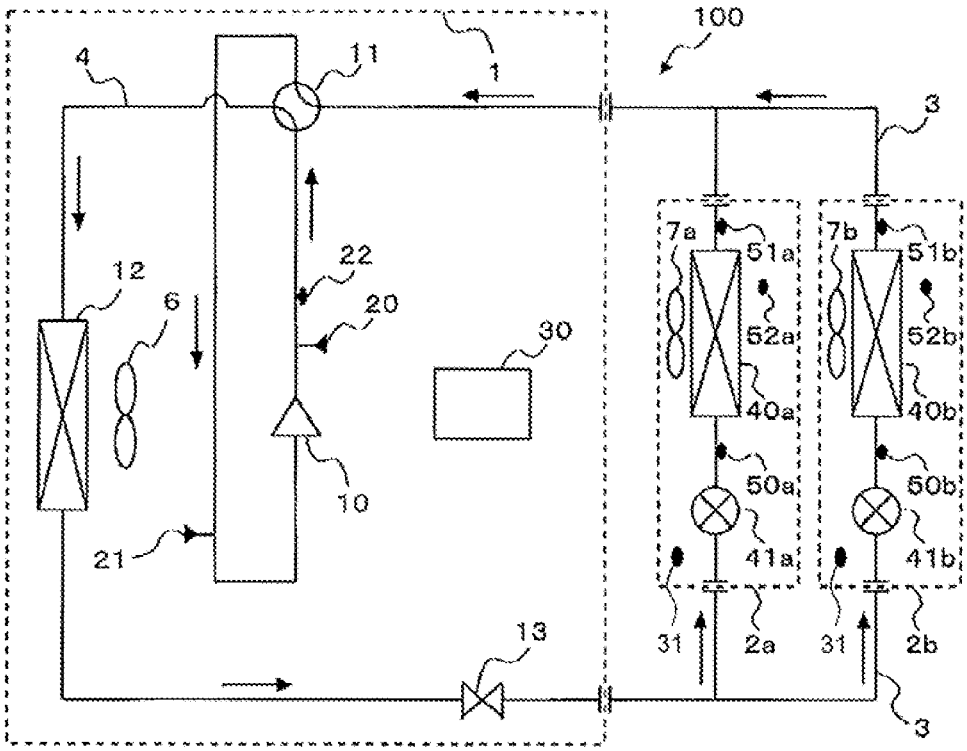
FIG. 3 is a refrigerant circuit diagram showing flows of refrigerant in cooling operation mode of the air-conditioning apparatus according to Embodiment 1 of the present invention.

Next, operation of the air-conditioning apparatus 100 shown in FIG. 1 in cooling operation mode will be described. FIG. 3 is a refrigerant circuit diagram showing flows of refrigerant in the cooling operation mode of the air-conditioning apparatus according to Embodiment 1 of the present invention. In FIG. 3, flow directions of refrigerant are indicated by solid arrows. In FIG. 3, the cooling operation mode will be described as an example in a case in which cooling loads are generated in the load heat exchangers 40*a* and 40*b*.

In the cooling operation mode, low-temperature, low-pressure refrigerant is compressed by the compressor 10 and discharged from the compressor 10 as high-temperature, high-pressure gas refrigerant. The high-temperature, high-pressure gas refrigerant discharged from the compressor 10 flows into the heat source heat exchanger 12 through the refrigerant flow switching device 11. The high-temperature, high-pressure gas refrigerant flowing into the heat source heat exchanger 12 condenses into high-pressure liquid refrigerant by transferring heat to outdoor air. Then, the high-pressure liquid refrigerant flowing out of the heat source heat exchanger 12 passes through the refrigerant circuit cutoff device 13 in an open state, flows out of the outdoor unit 1, passes through the main refrigerant pipes 3, and flows into the indoor units 2*a* and 2*b*.

When the refrigerant circuit cutoff device 13 is not capable of adjusting its opening degree as with solenoid valves and other similar devices, the controller 30 sets the refrigerant circuit cutoff device 13 to an open state. When the refrigerant circuit cutoff device 13 is capable of adjusting its opening area as with electronic expansion valves, the controller 30 sets the opening degree in such a manner that an operating state of the refrigeration cycle will not be adversely affected. For example, the controller 30 sets the refrigerant circuit cutoff device 13 to a fully open state in such a manner that cooling capacity and other indices of the operating state of the refrigeration cycle will not be adversely affected.

The high-pressure liquid refrigerant flowing into the indoor units 2*a* and 2*b* is decompressed by the expansion devices 41*a* and 41*b* into low-temperature, low-pressure, two-phase gas-liquid refrigerant, and then flows into the load heat exchangers 40*a* and 40*b* acting as evaporators. Then, the low-temperature, low-pressure, two-phase gas-liquid refrigerant cools indoor air by receiving heat from the indoor air and thereby becomes low-temperature, low-pressure gas refrigerant. The low-temperature, low-pressure gas refrigerant flowing out of the load heat exchangers 40*a* and 40*b* flows into the outdoor unit 1 through the main refrigerant pipes 3. The refrigerant flowing into the outdoor unit 1 passes through the refrigerant flow switching device 11 and is suctioned into the compressor 10.

The controller 30 controls the opening degrees of the expansion devices 41*a* and 41*b* in such a manner that a degree of superheat obtained as a difference between the temperature detected by the second temperature sensors 50*a* and 50*b* and the temperature detected by the third temperature sensors 51*a* and 51*b* will be constant.

Figure 4:
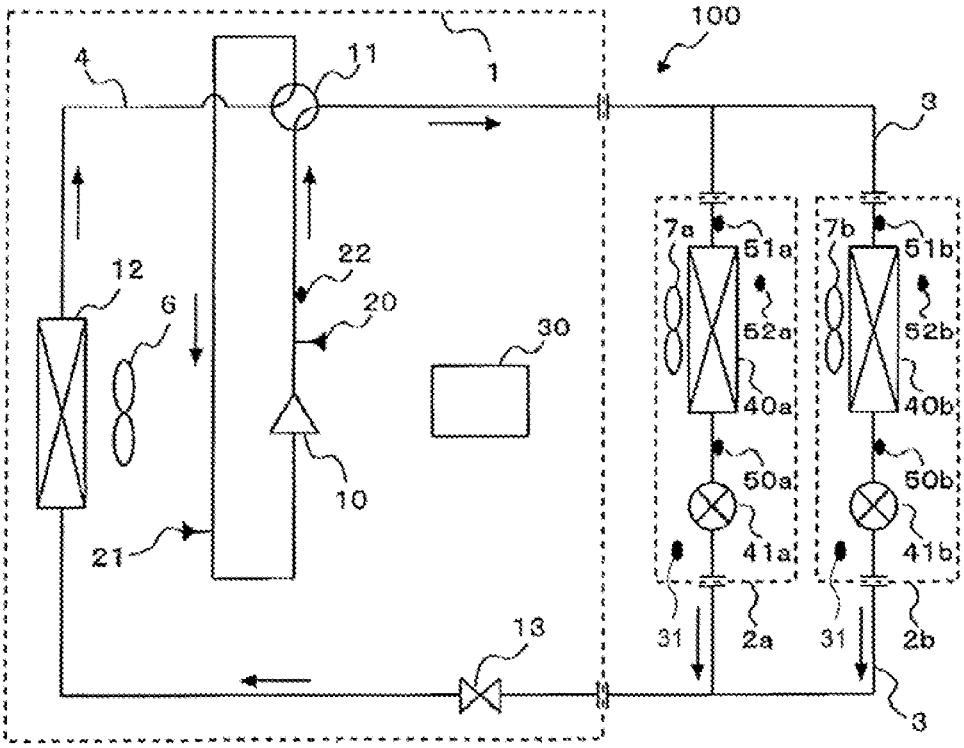
FIG. 4 is a refrigerant circuit diagram showing flows of refrigerant in heating operation mode of the air-conditioning apparatus according to Embodiment 1 of the present invention.

Next, operation of the air-conditioning apparatus 100 shown in FIG. 1 in heating operation mode will be described. FIG. 4 is a refrigerant circuit diagram showing flows of refrigerant in the heating operation mode of the air-conditioning apparatus according to Embodiment 1 of the present invention. In FIG. 4, flow directions of refrigerant are indicated by solid arrows. In FIG. 4, the heating operation mode will be described as an example in a case in which heating loads are generated in the load heat exchangers 40*a* and 40*b*.

In the heating operation mode, low-temperature, low-pressure refrigerant is compressed by the compressor 10 and discharged from the compressor 10 as high-temperature, high-pressure gas refrigerant. The high-temperature, high-pressure gas refrigerant discharged from the compressor 10 passes through the refrigerant flow switching device 11 and flows into the indoor units 2*a* and 2*b* through the main refrigerant pipes 3. The high-temperature, high-pressure gas refrigerant flowing into the indoor units 2*a* and 2*b* transfers heat to the indoor air in the load heat exchangers 40*a* and 40*b*, thereby becomes high-pressure liquid refrigerant, and then flows into the expansion devices 41*a* and 41*b*. Then, the high-pressure liquid refrigerant is decompressed by the expansion devices 41*a* and 41*b* into low-temperature, low-pressure, two-phase gas-liquid refrigerant, then flows out of the indoor units 2*a* and 2*b*, passes through the main refrigerant pipes 3, and flows into the outdoor unit 1.

The low-temperature, low-pressure, two-phase gas-liquid refrigerant flowing into the outdoor unit 1 passes through the refrigerant circuit cutoff device 13 in an open state, receives heat from the outdoor air in the heat source heat exchanger 12, and thereby becomes low-temperature, low-pressure gas refrigerant. The low-temperature, low-pressure gas refrigerant leaving the heat source heat exchanger 12 passes through the refrigerant flow switching device 11 and is suctioned into the compressor 10.

When the refrigerant circuit cutoff device 13 is not capable of adjusting its opening degree as with solenoid valves and other similar devices, the controller 30 sets the refrigerant circuit cutoff device 13 to an open state. When the refrigerant circuit cutoff device 13 is capable of adjusting its opening area as with electronic expansion valves, the controller 30 sets the opening degree in such a manner that an operating state of the refrigeration cycle will not be adversely affected. For example, the controller 30 sets the refrigerant circuit cutoff device 13 to a fully open state in such a manner that heating capacity and other indices of the operating state of the refrigeration cycle will not be adversely affected.

The controller 30 controls the opening degrees of the expansion devices 41*a* and 41*b* in such a manner that a degree of subcooling obtained as a difference between saturated liquid temperature of refrigerant calculated from pressure detected by the first pressure sensor 20 and the temperature detected by the second temperature sensors 50*a* and 50*b* will be constant.

Figure 5:
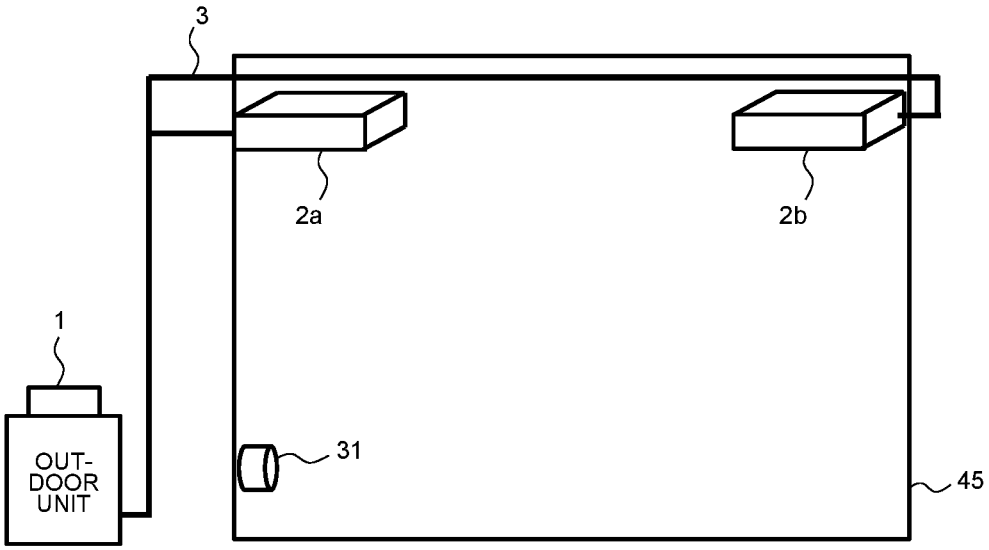
FIG. 5 is a diagram showing an installation example of an outdoor unit, indoor units, and a refrigerant leakage sensor in the air-conditioning apparatus according to Embodiment 1 of the present invention.
Figure 6:
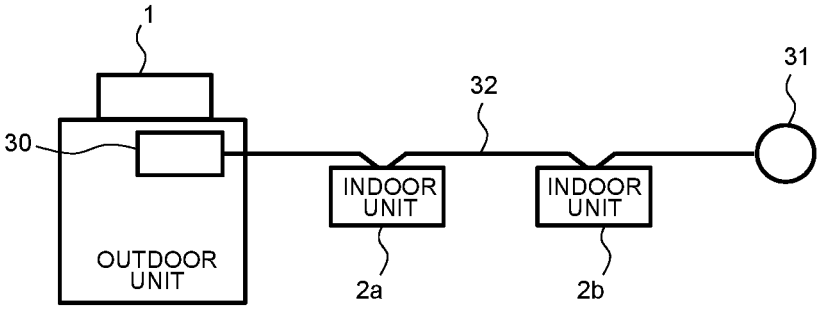
FIG. 6 is a diagram showing an example of how the outdoor unit, indoor units, and refrigerant leakage sensor are connected via a transmission line in the air-conditioning apparatus according to Embodiment 1 of the present invention.

Next, operation of the controller 30 related to the function to receive a refrigerant leakage detection signal and the function to reduce refrigerant leakage will be described. First, the function to receive a refrigerant leakage detection signal will be described. FIG. 5 is a diagram showing an installation example of the outdoor unit, indoor units, and refrigerant leakage sensor in the air-conditioning apparatus according to Embodiment 1 of the present invention. FIG. 6 is a diagram showing an example of how the outdoor unit, indoor units, and refrigerant leakage sensor are connected via a transmission line in the air-conditioning apparatus according to Embodiment 1 of the present invention.

As shown in FIG. 5, the indoor units 2*a* and 2*b* are connected to the outdoor unit 1 via the main refrigerant pipes 3. As shown in FIG. 5, the refrigerant leakage sensor 31 is installed in a space air-conditioned by the indoor units 2*a* and 2*b*. Whereas in the example shown in FIG. 5, the indoor units 2*a* and 2*b* air-condition an identical room 45, the indoor units 2*a* and 2*b* may air-condition different rooms. In this case, the refrigerant leakage sensor 31 may be provided in each of the different rooms.

As shown in FIG. 6, the refrigerant leakage sensor 31 is connected to the controller 30 of the outdoor unit 1 via a transmission line 32. Whereas in the configuration example shown in FIG. 6, the indoor units 2*a* and 2*b* relay the transmission line 32 between the refrigerant leakage sensor 31 and controller 30, the method for connecting the transmission line 32 between the refrigerant leakage sensor 31 and controller 30 is not limited to the configuration shown in FIG. 6.

When the refrigerant leakage sensor 31 detects refrigerant leakage, the refrigerant leakage sensor 31 transmits a refrigerant leakage detection signal to the controller 30 via the transmission line 32. The controller 30 receives the refrigerant leakage detection signal from the refrigerant leakage sensor 31. The controller 30 receives the refrigerant leakage detection signal using the function to receive a refrigerant leakage detection signal and recognizes that one of the two conditions for determination of refrigerant leakage has proved true. In Embodiment 1, description will be given of a case in which in response to reception of a refrigerant leakage detection signal, the controller 30 moves to determination as to whether refrigerant leakage occurs on the basis of operation status.

Note that although a case in which signal transmission from the refrigerant leakage sensor 31 to the controller 30 is done by wire has been described with reference to FIG. 6, signal transmission units available for use are not limited to wired ones. Any signal transmission unit may be used as long as a signal output by the refrigerant leakage sensor 31 can be received by the controller 30. For example, the refrigerant leakage sensor 31 may transmit the signal to the controller 30 by radio. When the signal transmission unit is a wireless one, there is no need to provide a transmission line 32 between the refrigerant leakage sensor 31 and controller 30. On the other hand, when the signal transmission unit is a wireless one, if frequency of a radio signal transmitted to the controller 30 from the refrigerant leakage sensor 31 is close to frequency of a signal used in another communication, the signals may interfere with each other. In this case, a wired signal transmission unit may be selected. As described above, the signal transmission unit can be selected depending on a communications environment of a location where the air-conditioning apparatus 100 is installed, a distance between positions of the outdoor unit 1 and refrigerant leakage sensor 31, and other similar factors.

Figure 7:
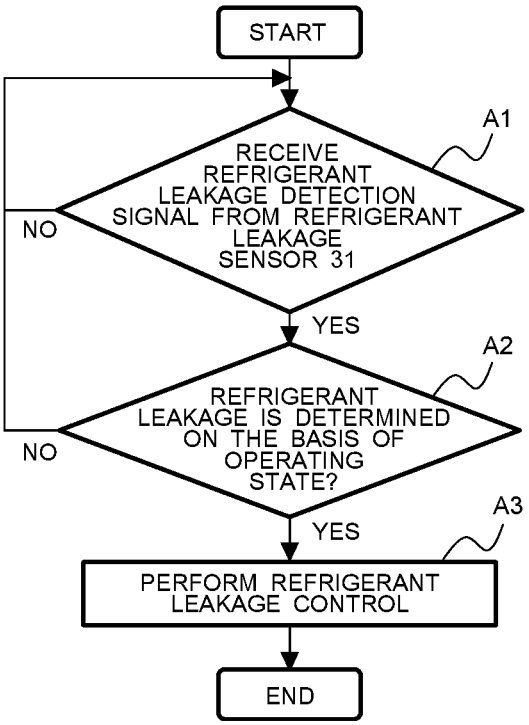
FIG. 7 is a flowchart showing an operating procedure conducted when refrigerant leakage is detected in the air-conditioning apparatus according to Embodiment 1 of the present invention.

Next, description will be given of an operation performed when the controller 30 performs the function to receive a refrigerant leakage detection signal and then performs the function to reduce refrigerant leakage. FIG. 7 is a flowchart showing an operating procedure conducted when refrigerant leakage is detected in the air-conditioning apparatus according to Embodiment 1 of the present invention.

The controller 30 monitors any signal output by the refrigerant leakage sensor 31 and determines whether to receive a refrigerant leakage detection signal from the refrigerant leakage sensor 31 (step A1). When the refrigerant leakage sensor 31 detects refrigerant leakage, the refrigerant leakage sensor 31 transmits a refrigerant leakage detection signal to the controller 30. When the controller 30 receives the refrigerant leakage detection signal in step A1, the controller 30 goes to a determination process of step A2. On the other hand, when no refrigerant leakage detection signal is received from the refrigerant leakage sensor 31, the controller 30 continues monitoring any signal output by the refrigerant leakage sensor 31.

When the controller 30 receives the refrigerant leakage detection signal from the refrigerant leakage sensor 31, the controller 30 determines whether refrigerant leakage occurs on the basis of an operating state of the air-conditioning apparatus 100 (step A2). When the controller 30 determines as a result that refrigerant leakage occurs, the controller 30 performs refrigerant leakage control as a safety measure against refrigerant leakage (step A3). In step A3, the controller 30 cuts off a refrigerant flow in the refrigerant circuit, for example, by setting the refrigerant circuit cutoff device 13 to a closed state and thereby reduces the refrigerant leakage. On the other hand, when the controller 30 determines as a result of the determination in step A2 that no refrigerant leakage occurs, the controller 30 returns to step A1.

Next, description will be given of examples of methods used by the controller 30 to determine whether refrigerant leakage occurs on the basis of the operating state of the air-conditioning apparatus 100.

(1) Method for Determining Whether Refrigerant Leakage Occurs on the Basis of a Detection Value of the First Temperature Sensor 22

If refrigerant leakage occurs when the opening degrees of the expansion devices 41*a* and 41*b*, rotation frequency of the compressor 10, and rotation frequency and other parameters of the air-sending device 6 are kept constant, the temperature T1 detected by the first temperature sensor 22 increases regardless of whether the operation mode is cooling or heating. The controller 30 uses the temperature T1 as an index of the operating state, i.e., as a criterion in determining whether refrigerant leakage occurs. The controller 30 compares discharge temperature of the compressor 10 with a predetermined reference value, determines whether the discharge temperature is higher than the reference value, and thereby determines whether refrigerant leakage occurs. The reference value is prestored in the memory 35 shown in FIG. 2.

(2) Method for Determining Whether Refrigerant Leakage Occurs on the Basis of a Degree of Superheat During cooling operation of the air-conditioning apparatus 100, the controller 30 controls the opening degrees of the expansion devices 41*a* and 41*b* in such a manner that the degree of superheat obtained as a difference between the temperature detected by the second temperature sensors 50*a* and 50*b* and the temperature detected by the third temperature sensors 51*a* and 51*b* will be constant. If refrigerant leakage occurs during cooling operation, the degree of superheat becomes excessive, and the opening degrees of the expansion devices 41*a* and 41*b* tend to increase. On the basis of this phenomenon, the controller 30 uses the degree of superheat as an index of the operating state, i.e., as a criterion in determining whether refrigerant leakage occurs. The controller 30 compares the calculated degree of superheat with a predetermined reference value, determines whether the degree of superheat is higher than the reference value, and thereby determines whether refrigerant leakage occurs. The reference value is prestored in the memory 35 shown in FIG. 2. Note that instead of the calculated degree of superheat, the controller 30 may use the opening degrees of the expansion devices 41*a* and 41*b* as a criterion in determining whether refrigerant leakage occurs. Also, the controller 30 may calculate the degree of superheat during heating operation.

(3) Method for Determining Whether Refrigerant Leakage Occurs on the Basis of a Degree of Subcooling During heating operation of the air-conditioning apparatus 100, the controller 30 controls the opening degrees of the expansion devices 41*a* and 41*b* in such a manner that a degree of subcooling obtained as a difference between saturated liquid temperature of refrigerant calculated from the pressure P1 detected by the first pressure sensor 20 and the temperature detected by the second temperature sensors 50*a* and 50*b* will be constant. If refrigerant leakage occurs during heating operation, the degree of subcooling becomes too low, and the opening degrees of the expansion devices 41*a* and 41*b* tend to decrease. On the basis of this phenomenon, the controller 30 uses the degree of subcooling as an index of the operating state, i.e., as a criterion in determining whether refrigerant leakage occurs. The controller 30 compares the calculated degree of subcooling with a predetermined reference value, determines whether the degree of subcooling is lower than the reference value, and thereby determines whether refrigerant leakage occurs. The reference value is prestored in the memory 35 shown in FIG. 2. Note that instead of the calculated degree of subcooling, the controller 30 may use the opening degrees of the expansion devices 41*a* and 41*b* as a criterion in determining whether refrigerant leakage occurs. Also, the controller 30 may calculate the degree of subcooling during cooling operation.

(4) Method for Determining Whether Refrigerant Leakage Occurs on the Basis of a Value of Electric Current Supplied to the Compressor 10.

During cooling operation and heating operation, the controller 30 sets a value of electric current supplied to a non-illustrated motor of the compressor 10 in such a manner that the air-conditioned space will reach a preset temperature. In case of refrigerant leakage, for example, during cooling operation, density of the refrigerant gas suctioned into the compressor 10 decreases, causing a load on the compressor 10 to decrease accordingly, and therefore the value of electric current supplied to the compressor 10 tends to decrease. On the basis of this phenomenon, the controller 30 uses the value of electric current to the compressor 10 as an index of the operating state, i.e., as a criterion in determining whether refrigerant leakage occurs. The controller 30 compares the value of electric current to the compressor 10 with a predetermined reference value, determines whether the value of electric current is lower than the reference value, and thereby determines whether refrigerant leakage occurs. The reference value is prestored in the memory 35 shown in FIG. 2. Also, in this case, the index of the operating state may be an input value used to set the value of electric current supplied to the compressor 10.

Note that although concrete examples have been shown above in (1) to (4) in relation to criteria in determining whether refrigerant leakage occurs on the basis of the operating state of the air-conditioning apparatus 100, determination criteria are not limited to the above information. Among pieces of information representing the operating state, any piece of information that changes when the refrigerant in the refrigerant circuit of the air-conditioning apparatus 100 decreases due to refrigerant leakage, may be used as a determination criterion. Also, although FIG. 7 shows a case in which the controller 30 goes to a determination process based on the operating state after the controller 30 receives a refrigerant leakage detection signal, step A2 may be conducted before the determination in step A1. If step A2 is conducted before step A1, the controller 30 has to monitor the operating state every predetermined time interval, and thus it is efficient to conduct the steps in the order of step A1 and step A2.

Figure 8:
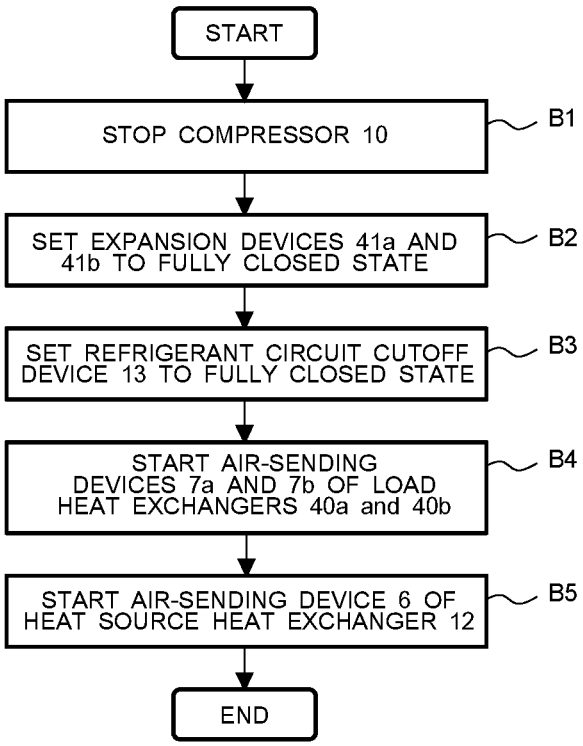
FIG. 8 is a flowchart showing operation of refrigerant leakage control in cooling operation mode and heating operation mode of the air-conditioning apparatus according to Embodiment 1 of the present invention.

Next, refrigerant leakage control performed by the controller 30 in the air-conditioning apparatus 100 will be described. FIG. 8 is a flowchart showing operation of refrigerant leakage control in cooling operation mode and heating operation mode of the air-conditioning apparatus according to Embodiment 1 of the present invention. First, with reference to FIG. 3, refrigerant leakage control performed if refrigerant leakage occurs when the air-conditioning apparatus 100 is operating in cooling operation mode will be described on a step by step basis as shown in FIG. 8.

As shown in step B1 of FIG. 8, the controller 30 stops the compressor 10. Next, as shown in step B2, the controller 30 sets the expansion devices 41*a* and 41*b* to a fully closed state. As shown in step B3 of FIG. 8, the controller 30 sets the refrigerant circuit cutoff device 13 to a fully closed state. Then, as shown in step B4, the controller 30 starts the air-sending devices 7*a* and 7*b* for the load heat exchangers 40*a* and 40*b*. Furthermore, as shown in step B5, the controller 30 starts the air-sending device 6 for the heat source heat exchanger 12.

In cooling operation mode there is a large mass of refrigerant in the form of liquid refrigerant in an interval between the heat source heat exchanger 12 and expansion device 41*a* and an interval between the heat source heat exchanger 12 and expansion 41*b* of the air-conditioning apparatus 100. Consequently, in case of refrigerant leakage, by performing the operation shown in FIG. 8, the controller 30 can reduce the amount of refrigerant leaking into the space in which the indoor units 2*a* and 2*b* are installed. Also, it is possible to prevent the refrigerant filled in the air-conditioning apparatus 100 from leaking out completely.

For example, if refrigerant leakage occurs somewhere in an interval between the expansion device 41*a* and the suction portion of the compressor 10 and an interval between the expansion device 41*b* and the suction portion of the compressor 10 in cooling operation mode, the amount of leaking refrigerant can be reduced significantly because all the refrigerant in the intervals is gas refrigerant except a slight amount of liquid refrigerant in the load heat exchangers 40*a* and 40*b*. Similarly, if refrigerant leakage occurs in an interval between the refrigerant circuit cutoff device 13 and the expansion device 41*a* or an interval between the refrigerant circuit cutoff device 13 and the expansion device 41*b*, because most part of the refrigerant in the interval is liquid refrigerant, a large amount of refrigerant leaks out.

However, it is possible to prevent the liquid refrigerant in the heat source heat exchanger 12 from leaking out.

Also, although it is not a case in which refrigerant leaks into the space in which the indoor units 2*a* and 2*b* are installed, if refrigerant leakage occurs in an interval between the discharge portion of the compressor 10 and the refrigerant circuit cutoff device 13, the liquid refrigerant in the heat source heat exchanger 12 leaks out. However, it is possible to prevent the liquid refrigerant in the interval between the refrigerant circuit cutoff device 13 and the expansion device 41*a* and the interval between the refrigerant circuit cutoff device 13 and the expansion device 41*b* from leaking out.

Note that although in the flowchart shown in FIG. 8, the operating sequence of actuators is specified by step numbers, the operating sequence is not limited to the one shown in FIG. 8. Operations in steps B1 to B5 provide similar effects even if the sequence is changed. Also, because in cooling operation mode, the air-sending device 6 for the heat source heat exchanger 12 is in operation, desirably the controller 30 operates the air-sending device 6 at full speed in step B5 to enhance the effect of diluting the leaking refrigerant. Similarly, in step B4, when the air-sending devices 7*a* and 7*b* for the indoor units 2*a* and 2*b* are in operation, desirably the controller 30 operates the air-sending devices 7*a* and 7*b* at full speed to enhance the effect of diluting the leaking refrigerant. Furthermore, when the air-sending devices 7*a* and 7*b* for the load heat exchangers 40*a* and 40*b* are at stop, in step B4, desirably the controller 30 not only starts the air-sending devices 7*a* and 7*b*, which are at stop, but also operates the air-sending devices 7*a* and 7*b*, which are operating, at full speed to enhance the effect of diluting the refrigerant.

Next, refrigerant leakage control performed by the controller 30 if refrigerant leakage occurs when the air-conditioning apparatus 100 is operating in heating operation mode will be described with reference to FIGS. 4 and 8. However, the operation of the refrigerant leakage control performed by the controller 30 in heating operation mode is similar to FIG. 8 referred to in the description of operation in the cooling operation mode, and thus description of operations in the steps shown in FIG. 8 will be omitted here.

In heating operation mode, a large amount of liquid refrigerant exists in an interval between the load heat exchanger 40*a* and heat source heat exchanger 12 and an interval between the load heat exchanger 40*b* and heat source heat exchanger 12 of the air-conditioning apparatus 100. Consequently, in case of refrigerant leakage in the heating operation mode shown in FIG. 4, by performing the refrigerant leakage control shown in FIG. 8, the controller 30 can reduce the amount of refrigerant leaking into the space in which the indoor units 2*a* and 2*b* are installed. Also, it is possible to prevent the refrigerant filled in the air-conditioning apparatus 100 from leaking out completely.

For example, if refrigerant leakage occurs somewhere in an interval between the discharge portion of the compressor 10 and the expansion device 41*a* and an interval between the discharge portion of the compressor 10 and the expansion device 41*b* in heating operation mode, because a large amount of liquid refrigerant exists in the load heat exchangers 40*a* and 40*b* in these intervals, some amount of refrigerant leaks out, but this operation will make it possible to prevent refrigerant leakage in an interval between the expansion device 41*a* and refrigerant circuit cutoff device 13 and an interval between the expansion device 41*b* and refrigerant circuit cutoff device 13.

If refrigerant leakage occurs in the interval between the expansion device 41*a* and refrigerant circuit cutoff device 13 and the interval between the expansion device 41*b* and refrigerant circuit cutoff device 13 similarly to the above case, because a large amount of liquid refrigerant exists in the intervals, even though a large amount of refrigerant leaks out, it is possible to prevent the liquid refrigerant in the load heat exchangers 40*a* and 40*b* from leaking out. Also, although it is not a case in which refrigerant leaks into the space in which the indoor units 2*a* and 2*b* are installed, if refrigerant leakage occurs in an interval between the refrigerant circuit cutoff device 13 and the suction portion of the compressor 10, because there is not much liquid refrigerant in the intervals, the refrigerant leakage can be reduced to a very small amount.

Note that also in the heating operation mode, the operating sequence of actuators is not limited to the one shown in FIG. 8. Also in the heating operation mode, the operations in steps B1 to B5 provide similar effects even if the sequence is changed. Also, regarding control over the air-sending device 6 and air-sending devices 7*a* and 7*b*, as with the cooling operation mode, in addition to starting the air-sending device 6 and air-sending devices 7*a* and 7*b*, which are at stop, desirably the controller 30 operates the air-sending devices at full speed to enhance the effect of diluting the leaking refrigerant. Furthermore, even when the air-sending device 6 and air-sending devices 7*a* and 7*b* are operating, desirably the controller 30 operates the air-sending devices at full speed to enhance the effect of diluting the leaking refrigerant.

Whereas with reference to FIG. 8, description has been given so far of a case in which refrigerant leakage occurs when the air-conditioning apparatus 100 is in cooling operation mode or heating operation mode, it is conceivable that refrigerant leakage will occur when the air-conditioning apparatus 100 is stopped or when operation of the air-conditioning apparatus 100 is suspended due to a thermo-off state. Thus, control performed when the air-conditioning apparatus 100 is stopped or when operation of the air-conditioning apparatus 100 is suspended due to a thermo-off state will be described. Hereinafter, the operation mode in which the air-conditioning apparatus 100 is stopped will be referred to as a stop mode and the operation mode in which the operation of the air-conditioning apparatus 100 is suspended due to a thermo-off state will be referred to as a thermo-off mode. Thermo-off is a state in which the air-conditioning apparatus 100 suspends its operation when detection values of various detection devices reach preset values. For example, in cooling operation mode, when indoor temperature falls to a preset temperature, the controller 30 suspends the operation of the air-conditioning apparatus 100, and this state corresponds to thermo-off.

Figure 9:
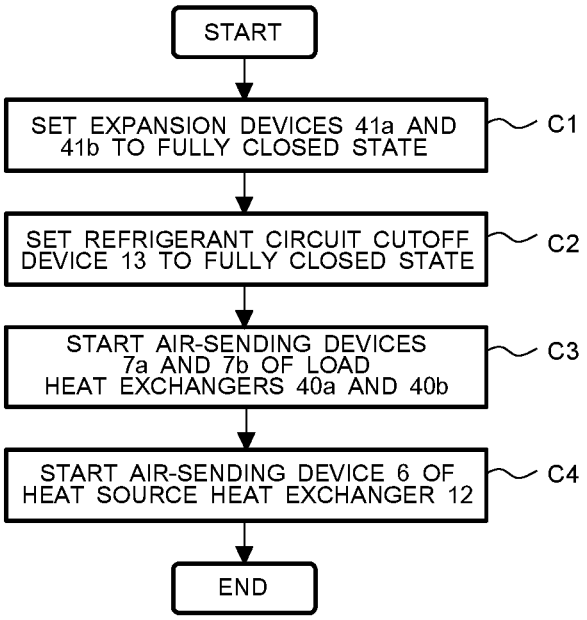
FIG. 9 is a flowchart showing operation of refrigerant leakage control in stop mode and thermo-off mode of the air-conditioning apparatus according to Embodiment 1 of the present invention.

Refrigerant leakage control performed if refrigerant leakage occurs when the air-conditioning apparatus 100 is in stop mode will be described. FIG. 9 is a flowchart showing operation of refrigerant leakage control in stop mode and thermo-off mode of the air-conditioning apparatus according to Embodiment 1 of the present invention. With reference to FIG. 1, refrigerant leakage control performed if refrigerant leakage occurs when the air-conditioning apparatus 100 is in stop mode will be described on a step by step basis as shown in FIG. 8.

As shown in step C1 of FIG. 9, the controller 30 sets the expansion devices 41*a* and 41*b* to a fully closed state. Next, as shown in step C2, the controller 30 sets the refrigerant circuit cutoff device 13 to a fully closed state. Then, as shown in step C3, the controller 30 starts the air-sending devices 7*a* and 7*b* for the load heat exchangers 40*a* and 40*b*. Furthermore, as shown in step C4, the controller 30 starts the air-sending device 6 for the heat source heat exchanger 12.

In the stop mode, because the location of liquid refrigerant in the air-conditioning apparatus 100 is affected by temperature conditions in and out of the room, an elapsed time after shutdown, and other conditions, the current location of liquid refrigerant changes from time to time depending on the situation. Consequently, by closing all closable actuators, the controller 30 keeps the refrigerant in the air-conditioning apparatus 100 from leaking out completely.

Note that although in the flowchart shown in FIG. 9, the operating sequence of actuators is specified by step numbers, the operating sequence is not limited to the one shown in FIG. 9. Operations in steps C1 to C4 provide similar effects even if the sequence is changed. Also, when the controller 30 starts the air-sending device 6 for the heat source heat exchanger 12 and the air-sending devices 7*a* and 7*b* for the load heat exchangers 40*a* and 40*b*, desirably the controller 30 operates the air-sending devices at full speed or at a speed close to the full speed to enhance the effect of diluting the leaking refrigerant.

Next, refrigerant leakage control performed if refrigerant leakage occurs when the air-conditioning apparatus 100 is in thermo-off mode will be described. However, the operation of the refrigerant leakage control performed by the controller 30 in thermo-off mode is similar to FIG. 9 referred to in the description of operation in the stop mode, and thus description of operations in the steps shown in FIG. 9 will be omitted here.

In the thermo-off mode, because the location of liquid refrigerant in the air-conditioning apparatus 100 is affected by temperature conditions in and out of the room, an elapsed time after thermo-off, and other conditions, the current location of liquid refrigerant changes from time to time depending on the situation. Consequently, by closing all closable actuators, the controller 30 keeps the refrigerant in the air-conditioning apparatus 100 from leaking out completely.

Note that also in the thermo-off mode, the operating sequence of actuators is not limited to the one shown in FIG. 9. Also in the thermo-off mode, the operations in steps C1 to C4 provide similar effects even if the sequence is changed. Also, regarding control over the air-sending device 6 and air-sending devices 7*a* and 7*b*, as with the stop mode, in addition to starting the air-sending device 6 and air-sending devices 7*a* and 7*b*, which are at stop, desirably the controller 30 operates the air-sending devices at full speed or at a speed close to the full speed to enhance the effect of diluting the leaking refrigerant.

As described above, when the refrigerant leakage sensor 31 detects refrigerant leakage, the controller 30 receives a refrigerant leakage detection signal from the refrigerant leakage sensor 31 using the function to receive a refrigerant leakage detection signal. Next, in response to reception of the refrigerant leakage detection signal, using the function to reduce refrigerant leakage, the controller 30 determines whether refrigerant leakage occurs on the basis of the operating state. Next, when the controller 30 determines that refrigerant leakage occurs, the controller 30 can effectively reduce the amount of leaking refrigerant by using the function to reduce refrigerant leakage and by controlling the compressor 10, expansion devices 41*a* and 41*b*, and refrigerant circuit cutoff device 13 depending on the operation mode.

Note that the controller 30 performs refrigerant leakage control in each operation mode to reduce the amount of leaking refrigerant, and depending on a combination of operation mode and a refrigerant leakage site, additional attention to safety may be needed. Consequently, the controller 30 may have at least one of a function to display information about occurrence of refrigerant leakage and a function to sound an alarm. Consequently, safety in the indoor space can be improved further. This is also true for other embodiments described later. Also, although in Embodiment 1, description has been given of a case in which the air-conditioning apparatus 100 has two operation modes of the cooling operation mode and heating operation mode, the air-conditioning apparatus 100 may have any one of the two operation modes.

The air-conditioning apparatus 100 according to Embodiment 1 includes the refrigerant circuit in which the compressor 10 and other devices are connected via refrigerant pipes; the refrigerant leakage sensor 31 configured to output a refrigerant leakage detection signal when the refrigerant leakage sensor 31 detects refrigerant leakage; the refrigerant circuit cutoff device 13 provided on the refrigerant pipe 4; and the controller 30 configured to determine whether refrigerant leakage occurs on the basis of the operating state and whether the refrigerant leakage detection signal has been received, in which when the controller 30 determines that refrigerant leakage occurs, the controller 30 sets the refrigerant circuit cutoff device 13 to the closed state and thereby cuts off a refrigerant flow in the refrigerant circuit.

According to Embodiment 1, as a determination as to whether refrigerant leakage occurs is made on the basis of the logical product of two conditions, i.e., the detection by the refrigerant leakage sensor 31 and the operating state, reliability of refrigerant leakage detection is improved. Then, when the controller 30 determines that refrigerant leakage occurs on the basis of the two conditions, the controller 30 cuts off the refrigerant flow in the refrigerant pipes 4, thereby reducing the refrigerant leakage, and when the controller 30 determines that no refrigerant leakage occurs on the basis of either one of the two conditions, the controller 30 maintains air-conditioning operation, thereby making it possible to combine comfort and safety.

For example, when the signal transmission unit for signal transmission from the refrigerant leakage sensor 31 to the controller 30 is a wireless one, if the controller 30 receives a wrong signal due to signal interference, the air-conditioning apparatus 100 of Embodiment 1 is particularly effective. This is because air-conditioning operation is maintained in this case if the controller 30 determines on the basis of the operating state that no refrigerant leakage occurs.

In Embodiment 1, as an index of the operating state, i.e., as a determination criterion for refrigerant leakage, the controller 30 may use any of the following indices of the discharge temperature of the compressor 10, degree of superheat, degree of subcooling, and electric current value and input value of the compressor 10. By determining whether refrigerant leakage occurs using any of the determination criteria, the controller 30 can determine whether refrigerant leakage occurs even if the refrigerant leakage sensor 31 falsely detects refrigerant leakage. Also, if something is wrong with any of the pressure sensors and temperature sensors provided in the air-conditioning apparatus 100, for example, if the first temperature sensor 22 cannot detect temperature properly, the controller 30 can determine whether refrigerant leakage occurs using an index of the operating state other than the discharge temperature of the compressor 10.

In Embodiment 1, when the controller 30 determines on the basis of the operating state that refrigerant leakage occurs, the controller 30 may stop the compressor 10 and set the expansion devices 41*a* and 41*b* to a closed state. In this case, because the expansion devices 41*a* and 41*b* and the refrigerant circuit cutoff device 13 trap the refrigerant between devices provided in the refrigerant circuit, the amount of leaking refrigerant can be reduced further.

In Embodiment 1, the refrigerant circuit cutoff device 13 is provided in the refrigerant circuit to cut off the refrigerant flow when refrigerant leakage is detected by two-step determination. This makes it possible to cut off the refrigerant flow in the refrigerant circuit and thereby curb the amount of leaking refrigerant.

In Embodiment 1, the refrigerant leakage sensor 31 may transmit the refrigerant leakage detection signal to the controller 30 by radio or by wire. When the signal transmission unit is a wireless one, there is no need to provide a transmission line 32 between the refrigerant leakage sensor 31 and controller 30. When the signal transmission unit is a wired one, it is possible to prevent signal interference that may be caused by another signal in case of radio signals.

In Embodiment 1, the refrigerant may be a flammable refrigerant such as R32 or a refrigerant mixture containing R32. Even if the refrigerant has flammability, if refrigerant leakage is detected by two-step determination, safety can be ensured by cutting off the refrigerant flow.

Embodiment 2

In Embodiment 1 described above, the refrigerant circuit cutoff device 13 installed on the refrigerant pipe of the air-conditioning apparatus 100 acts as a refrigerant leakage cutoff device configured to reduce refrigerant leakage. In Embodiment 2, the refrigerant leakage cutoff device is installed in a location outside the air-conditioning apparatus 100. The location outside the air-conditioning apparatus 100 means, for example, a duct interconnecting an indoor unit and a room.

Figure 10:
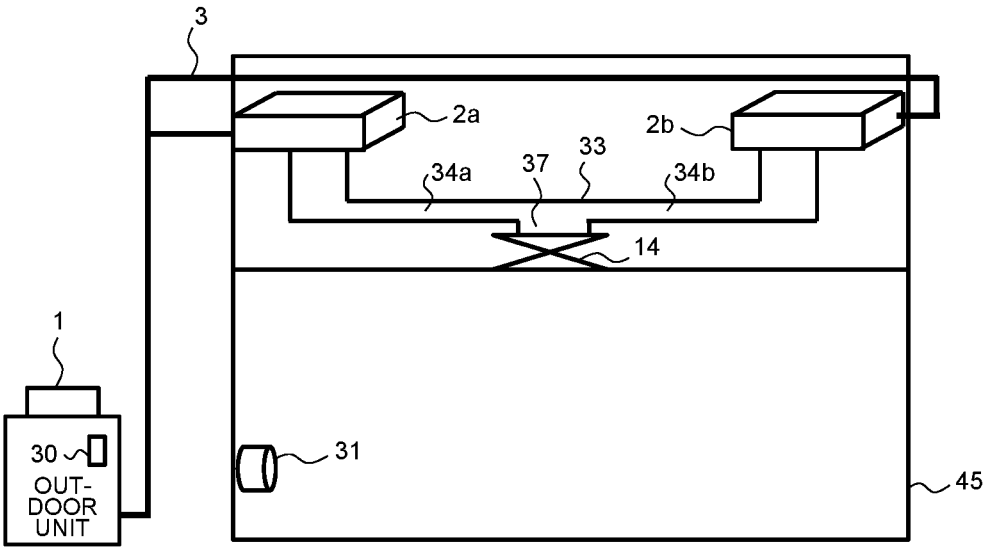
FIG. 10 is an external view showing a configuration example of an air-conditioning apparatus according to Embodiment 2 of the present invention.

FIG. 10 is an external view showing a configuration example of an air-conditioning apparatus according to Embodiment 2 of the present invention. FIG. 10 shows an installation example of the outdoor unit 1, the indoor units 2*a* and 2*b*, the refrigerant leakage sensors 31, a duct 33, and a refrigerant leakage cutoff device 14, but the installation locations of the devices are not limited to these installation locations shown in FIG. 10.

The configuration of the air-conditioning apparatus according to Embodiment 2 will be described with reference to FIG. 10. As shown in FIG. 10, the outdoor unit 1 and indoor units 2*a* and 2*b* are interconnected by the main refrigerant pipes 3. The indoor units 2*a* and 2*b* are connected to a room 45, which is a common air-conditioned space, by the duct 33. The duct 33 includes a branch duct 34*a* connected to the load heat exchanger 40*a* of the indoor unit 2*a*, a branch duct 34*b* connected to the load heat exchanger 40*b* of the indoor unit 2*b*, and a junction 37 joining together the branch ducts 34*a* and 34*b* and connecting the branch ducts 34*a* and 34*b* to the room 45. The duct 33 serves the role of allowing the air heat-exchanged by the load heat exchangers 40*a* and 40*b* to flow through the duct 33. The duct 33 allows cool air to flow into the room 45 during cooling operation of the indoor units 2*a* and 2*b* and allows warm air to flow into the room 45 during heating operation of the indoor units 2*a* and 2*b*.

The refrigerant leakage sensors 31 are installed in the room 45. The refrigerant leakage cutoff device 14 is provided in the junction 37 of the duct 33. The refrigerant leakage cutoff device 14 is a component capable of cutting off a flow of gas in a flow path of the junction 37. The refrigerant leakage cutoff device 14 is, for example, a damper. The outdoor unit 1, indoor units 2*a* and 2*b*, refrigerant leakage cutoff device 14, and refrigerant leakage sensors 31 are interconnected via a transmission line. The controller 30 may be connected with the refrigerant leakage sensors 31 by radio.

Next, operation of refrigerant leakage control of the air-conditioning apparatus shown in FIG. 10 will be described. Note that refrigerant leakage control in Embodiment 2 is similar to the control described with reference to FIGS. 7 to 9 in Embodiment 1, and thus differences from Embodiment 1 will be described here.

The refrigerant leakage sensor 31 detects refrigerant leakage and transmits a refrigerant leakage detection signal to the controller 30. In step A1 shown in FIG. 7, when the controller 30 receives the refrigerant leakage detection signal from the refrigerant leakage sensor 31, the controller 30 determines whether refrigerant leakage occurs on the basis of the operating state (step A2 of FIG. 7). When the controller 30 determines as a result that refrigerant leakage occurs, the controller 30 sets the refrigerant leakage cutoff device 14 to a closed state in step A3 shown in FIG. 7.

In Embodiment 2, when the controller 30 determines that refrigerant leakage occurs, the controller 30 sets the refrigerant leakage cutoff device 14 provided in the duct 33 linking the indoor units 2*a* and 2*b* to the room 45 to a closed state, thereby cutting off the refrigerant flowing from the duct 33 to the room 45. Consequently, even if refrigerant leakage occurs in either of the indoor units 2*a* and 2*b*, it is possible to prevent the refrigerant from flowing into the room 45 through the duct 33. In Embodiment 2, as with Embodiment 1, an outdoor unit and indoor unit may be connected in a one-to-one relationship.

Embodiment 3

Embodiment 3 is an air-conditioning system that includes a plurality of the air-conditioning apparatuses 100 described in Embodiment 1. In Embodiment 3, the plurality of the air-conditioning apparatuses 100 air-condition an identical space. Note that description of Embodiment 3 will be given of a case in which there are two air-conditioning apparatuses, but the number of air-conditioning apparatuses may be more than two.

Figure 11:
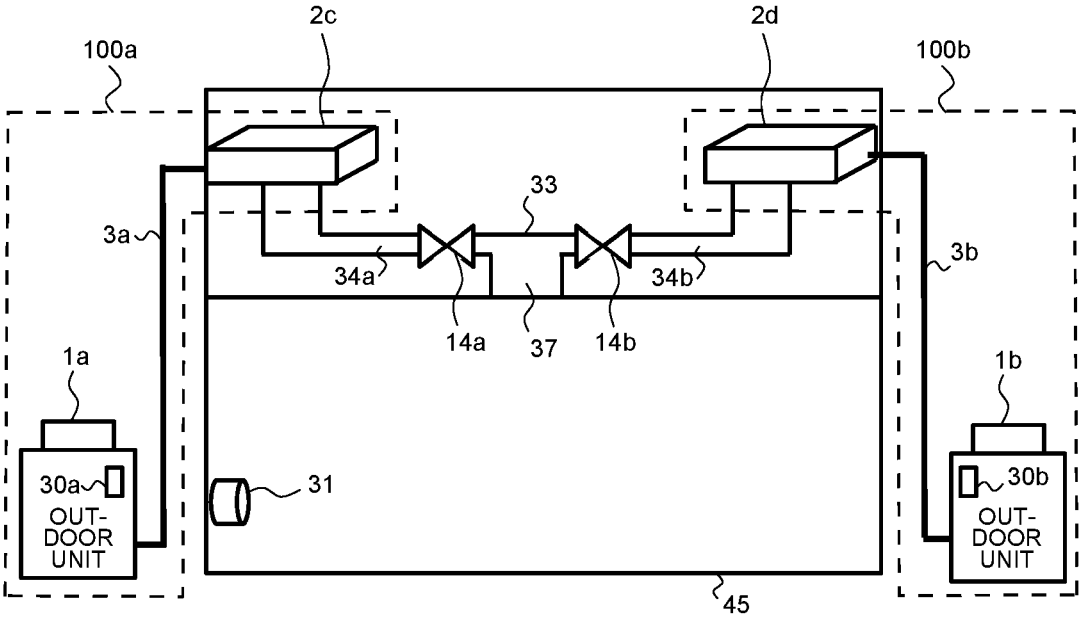
FIG. 11 is an external view showing a configuration example of an air-conditioning system according to Embodiment 3 of the present invention.

FIG. 11 is an external view showing a configuration example of the air-conditioning system according to Embodiment 3 of the present invention. FIG. 11 shows an installation example of outdoor units 1*a* and 1*b*, the indoor units 2*a* and 2*b*, the refrigerant leakage sensors 31, the duct 33, and refrigerant leakage cutoff devices 14*a* and 14*b*, but the installation locations of the devices are not limited to these installation locations shown in FIG. 11.

The configuration of the air-conditioning system according to Embodiment 3 will be described with reference to FIG. 11. As shown in FIG. 11, the air-conditioning system includes an air-conditioning apparatus 100*a* and an air-conditioning apparatus 100*b*. The air-conditioning apparatus 100*a* includes the outdoor unit 1*a* and an indoor unit 2*c*. The outdoor unit 1*a* is connected with the indoor unit 2*c* via a main refrigerant pipe 3*a*. The air-conditioning apparatus 100*b* includes the outdoor unit 1*b* and an indoor unit 2*d*. The outdoor unit 1*b* is connected with the indoor unit 2*d* via a main refrigerant pipe 3*b*. The indoor units 2*c* and 2*d* are connected to the room 45, which is a common air-conditioned space, by the duct 33.

The duct 33 includes the branch duct 34*a* connected to a load heat exchanger of the indoor unit 2*c*, the branch duct 34*b* connected to a load heat exchanger of the indoor unit 2*d*, and the junction 37 joining together the branch ducts 34*a* and 34*b* and connecting the branch ducts 34*a* and 34*b* to the room 45. The refrigerant leakage cutoff device 14*a* configured to cut off the refrigerant leaking out of the air-conditioning apparatus 100*a* is provided in the branch duct 34*a*. The refrigerant leakage cutoff device 14*b* configured to cut off the refrigerant leaking out of the air-conditioning apparatus 100*b* is provided in the branch duct 34*b*. The duct 33 allows the air heat-exchanged by the load heat exchangers in corresponding operation modes of the indoor units 2*c* and 2*d* to flow to the room 45. The outdoor unit 1*a*, indoor unit 2*c*, refrigerant leakage cutoff device 14*a*, and refrigerant leakage sensor 31 are interconnected via a transmission line. The outdoor unit 1*b*, indoor unit 2*d*, refrigerant leakage cutoff device 14*b*, and refrigerant leakage sensor 31 are interconnected via a transmission line. Controllers 30*a* and 30*b* may be connected with the refrigerant leakage sensors 31 by radio.

Next, operation of refrigerant leakage control on the air-conditioning system shown in FIG. 11 will be described. Note that the refrigerant leakage control in Embodiment 3 will be described by focusing on differences from the control described with reference to FIGS. 7 to 9 in Embodiment 1.

The refrigerant leakage sensor 31 detects refrigerant leakage and transmits a refrigerant leakage detection signal to a corresponding one of the controllers 30*a* and 30*b*. In step A1 shown in FIG. 7, when the corresponding one of the controllers 30*a* and 30*b* receives the refrigerant leakage detection signal from the refrigerant leakage sensor 31, the corresponding one of the controllers 30*a* and 30*b* determines whether refrigerant leakage occurs on the basis of the operating state (step A2 of FIG. 7). When the corresponding one of the controllers 30*a* and 30*b* determines as a result that refrigerant leakage occurs, the corresponding one of the controllers 30*a* and 30*b* sets a corresponding one of the refrigerant leakage cutoff devices 14*a* and 14*b* to a closed state in step A3 shown in FIG. 7.

In step A2, if the controller 30*a* determines that refrigerant leakage occurs and the controller 30*b* determines that no refrigerant leakage occurs, then in step A3, the controller 30*a* sets the refrigerant leakage cutoff device 14*a* to a closed state, but the controller 30*b* keeps the refrigerant leakage cutoff device 14*b* in an open state. Conversely, in step A2, if the controller 30*a* determines that no refrigerant leakage occurs and the controller 30*b* determines that refrigerant leakage occurs, then in step A3, the controller 30*a* keeps the refrigerant leakage cutoff device 14*a* in an open state, but the controller 30*b* sets the refrigerant leakage cutoff device 14*b* to a closed state. Note that when both the controllers 30*a* and 30*b* determine that refrigerant leakage occurs, the refrigerant leakage cutoff devices 14*a* and 14*b* are set to a closed state.

As described above, when the air-conditioning apparatuses 100*a* and 100*b* are air-conditioning an identical air-conditioned space, by cutting off only the air flowing in from the air-conditioning apparatus in which refrigerant leakage occurs, the remaining air-conditioning apparatus can continue operation. This makes it possible to avoid stopping all the air-conditioning apparatuses and maintain user comfort.

The air-conditioning system according to Embodiment 3 is configured in such a manner that a plurality of the air-conditioning apparatuses air-condition the same air-conditioned space and share a refrigerant leakage sensor and that the refrigerant leakage cutoff device is set to a closed state only in the air-conditioning apparatus in which refrigerant leakage is determined to occur on the basis of the operating state, but that the refrigerant leakage cutoff device is not operated in the remaining air-conditioning apparatus. This makes it possible to reduce refrigerant leakage while continuing air-conditioning operation. This in turn makes it possible to combine comfort and safety.

The invention claimed is:

1. An air-conditioning apparatus, comprising:

a refrigerant circuit in which a compressor, a heat source heat exchanger, an expansion valve, and a load heat exchanger are connected via refrigerant pipes;

a refrigerant leakage sensor configured to output a refrigerant leakage detection signal indicating detection of refrigerant leakage when the refrigerant leakage sensor detects the refrigerant leakage;

a refrigerant circuit cutoff valve configured to cut off a flow of a refrigerant when the refrigerant circuit cutoff valve is set to a closed state; and a controller programmed to:

determine whether refrigerant leakage occurs on a basis of both (i) an operating state of a refrigeration cycle of the refrigerant, wherein the operating state is determined based on an index stored in a memory, and (ii) whether the refrigerant leakage detection signal is received from the refrigerant leakage sensor, when the controller receives the refrigerant leakage detection signal and determines, on a basis of the operating state of the refrigeration cycle, that the refrigerant leakage occurs, control the refrigerant circuit cutoff valve to be set to the closed state for control of refrigerant leakage, when the controller receives only one of (i) a signal indicative of the operating state or (ii) the refrigerant leakage detection signal, the controller maintains the operating state of the air-conditioning apparatus.

2. The air-conditioning apparatus of claim 1, further comprising a temperature sensor configured to detect discharge temperature of refrigerant discharged from the compressor, wherein the controller is configured to determine whether the refrigerant leakage occurs by comparing the discharge temperature serving as the index of the operating state with a predetermined reference value.

3. The air-conditioning apparatus of claim 1, further comprising two temperature sensors each configured to detect a corresponding one of temperature of refrigerant at a portion connecting the load heat exchanger that is close to the expansion valve and temperature of refrigerant at a portion across the load heat exchanger from the expansion valve, wherein the controller is configured to calculate a degree of superheat as the index of the operating state using the temperatures detected by the two temperature sensors and determine whether the refrigerant leakage occurs by comparing the degree of superheat that is calculated with a predetermined reference value.

4. The air-conditioning apparatus of claim 1, further comprising:

a pressure sensor configured to detect pressure of refrigerant discharged from the compressor; and a temperature sensor configured to detect temperature of refrigerant at a portion connecting the load heat exchanger that is close to the expansion valve, wherein the controller is configured to calculate a degree of subcooling as the index of the operating state using saturated liquid temperature obtained from the pressure and the temperature detected by the temperature sensor and determine whether the refrigerant leakage occurs by comparing the degree of subcooling that is calculated with a predetermined reference value.

5. The air-conditioning apparatus of claim 1, wherein the controller is configured to determine whether the refrigerant leakage occurs by comparing an electric current value of the compressor or an input value used to set the electric current value with a predetermined reference value, the electric current value or the input value serving as the index of the operating state.

6. The air-conditioning apparatus of claim 1, wherein when the controller determines that the refrigerant leakage occurs, the controller is configured to stop the compressor and set the expansion valve to a closed state.

7. The air-conditioning apparatus of claim 1, wherein the refrigerant leakage sensor is configured to transmit the refrigerant leakage detection signal to the controller by radio or by wire.

8. The air-conditioning apparatus of claim 1, wherein the refrigerant has flammability.

9. The air-conditioning apparatus of claim 1, wherein the refrigerant circuit cutoff valve is provided in the refrigerant circuit.

10. An air-conditioning apparatus, comprising:

a refrigerant circuit in which a compressor, a heat source heat exchanger, an expansion valve, and a load heat exchanger are connected via refrigerant pipes;

a refrigerant leakage sensor configured to output a refrigerant leakage detection signal indicating detection of refrigerant leakage when the refrigerant leakage sensor detects the refrigerant leakage;

a cutoff damper configured to cut off a flow of air heat-exchanged by the load heat exchanger flowing through a duct when the cutoff damper is set to a closed state; and a controller programmed to:

determine whether refrigerant leakage occurs on a basis of both (i) an operating state of a refrigeration cycle of the refrigerant, wherein the operating state is determined based on an index stored in a memory, and (ii) whether the refrigerant leakage detection signal is received from the refrigerant leakage sensor, when the controller receives the refrigerant leakage detection signal and determines, on a basis of the operating state of the refrigeration cycle, that the refrigerant leakage occurs, control the cutoff damper to be set to the closed state for control of air flowing through the duct, when the controller receives only one of (i) a signal indicative of the operating state or (ii) the refrigerant leakage detection signal, the controller maintains the operating state of the air-conditioning apparatus.

11. The air-conditioning apparatus of claim 10, wherein the cutoff damper is provided in a duct through which air heat-exchanged by the load heat exchanger flows.

12. An air-conditioning system, comprising:

a plurality of the air-conditioning apparatuses of claim 10; and a duct including a plurality of branch ducts each connected to a corresponding one of a plurality of the load heat exchangers, and a junction joining together the plurality of branch ducts and connecting the plurality of branch ducts to a space, wherein the plurality of the air-conditioning apparatuses are each configured to air-condition the space and share the refrigerant leakage sensor installed in the space, a plurality of the cutoff dampers are each provided in a corresponding one of the plurality of branch ducts, and when one of a plurality of the controllers determines that the refrigerant leakage occurs, the one of the plurality of the controllers is configured to set a corresponding one of the plurality of the cutoff dampers provided in a corresponding one of the plurality of branch ducts connected to the load heat exchanger of a corresponding one of the plurality of the air-conditioning apparatuses to the closed state.

13. The air-conditioning apparatus of claim 10, further comprising a temperature sensor configured to detect discharge temperature of refrigerant discharged from the compressor, wherein the controller is configured to determine whether the refrigerant leakage occurs by comparing the discharge temperature serving as the index of the operating state with a predetermined reference value.

14. The air-conditioning apparatus of claim 10, further comprising two temperature sensors each configured to detect a corresponding one of temperature of refrigerant at a portion connecting the load heat exchanger that is close to the expansion valve and temperature of refrigerant at a portion across the load heat exchanger from the expansion valve, wherein the controller is configured to calculate a degree of superheat as the index of the operating state using the temperatures detected by the two temperature sensors and determine whether the refrigerant leakage occurs by comparing the degree of superheat that is calculated with a predetermined reference value.

15. The air-conditioning apparatus of claim 10, further comprising:

a pressure sensor configured to detect pressure of refrigerant discharged from the compressor; and a temperature sensor configured to detect temperature of refrigerant at a portion connecting the load heat exchanger that is close to the expansion valve, wherein the controller is configured to calculate a degree of subcooling as the index of the operating state using saturated liquid temperature obtained from the pressure and the temperature detected by the temperature sensor and determine whether the refrigerant leakage occurs by comparing the degree of subcooling that is calculated with a predetermined reference value.

16. The air-conditioning apparatus of claim 10, wherein the controller is configured to determine whether the refrigerant leakage occurs by comparing an electric current value of the compressor or an input value used to set the electric current value with a predetermined reference value, the electric current value or the input value serving as the index of the operating state.

17. The air-conditioning apparatus of claim 10, wherein when the controller determines that the refrigerant leakage occurs, the controller is configured to stop the compressor and set the expansion valve to a closed state.

18. The air-conditioning apparatus of claim 10, wherein the refrigerant leakage sensor is configured to transmit the refrigerant leakage detection signal to the controller by radio or by wire.

19. The air-conditioning apparatus of claim 10, wherein the refrigerant has flammability.

* * * * *